US005816952A

United States Patent [19]

Blevins

[11] Patent Number: 5,816,952

[45] Date of Patent: Oct. 6, 1998

[54] BASKETBALL SHOOTING TRAINER

[76] Inventor: Mark William Blevins, 6415 Sacramento Ave., Alta Loma, Calif. 91701

[21] Appl. No.: 907,737

[22] Filed: Aug. 8, 1997

[51] Int. Cl.[6] ..... A63B 69/00

[52] U.S. Cl. ..... 473/450

[58] Field of Search ..... 473/450

[56] References Cited

U.S. PATENT DOCUMENTS

| | | | |
|---|---|---|---|
| 3,820,783 | 6/1974 | Caveness | 473/450 |
| 4,377,284 | 3/1983 | Okerlin | 473/450 |
| 4,383,685 | 5/1983 | Bishop | 473/450 |
| 4,579,341 | 4/1986 | Furr | 473/450 |
| 4,919,425 | 4/1990 | Wolf | 473/450 |
| 5,135,217 | 8/1992 | Swain | 473/450 |
| 5,149,085 | 9/1992 | Sanchez | 473/450 |
| 5,160,138 | 11/1992 | Sanders | 473/450 |
| 5,228,682 | 7/1993 | Wolf | 473/450 |
| 5,271,617 | 12/1993 | Gilford | 473/450 |
| 5,320,342 | 6/1994 | Houck | 473/450 |
| 5,544,877 | 8/1996 | Brownell | 473/450 |

*Primary Examiner*—William H. Grieb

*Attorney, Agent, or Firm*—Knobbe, Martens Olson & Bear, LLP

[57] ABSTRACT

Disclosed is an apparatus for training a basketball player to properly shoot a basketball. In a preferred embodiment, the apparatus includes a series of sleeves that are attached to the player's shooting arm and guide arm. A connecting member maintains the player's arms in close proximity and a tension member biases the player's wrist in a cocked position using a disk that is placed over the shooting hand. A player may repeatedly perform a shooting motion while using the device so that the player's muscles memorize and grow accustomed to the proper shooting technique.

19 Claims, 1 Drawing Sheet

BASKETBALL SHOOTING TRAINER

BACKGROUND OF THE INVENTION

This application claims the benefit of U.S. Provisional Application No. 60/023,621, filed Aug. 9, 1996.

1. Field of the Invention

The present invention relates to an apparatus for training a basketball player to shoot a basketball, and in particular relates to an apparatus that will train a basketball player to use proper wrist motion while shooting a basketball and also train the player position his or her arms in the proper position relative to each other and relative to the player's torso.

2. Description of the Related Art

It has been demonstrated that certain shooting techniques will increase a basketball player's chance of successfully shooting a basketball into a basket. One important component of shooting a basketball is proper wrist motion. In shooting a basket, the player should initially prop the ball on his or her shooting hand, with the wrist cocked so that the shooting hand is substantially parallel to the ground. As the player shoots the basketball, the player should uncock his or her wrist in an arcing motion and thus propel the basket through the air, preferably into a basket. However, proper wrist motion will not suffice if the player does not properly position his or her arms while shooting the ball. Generally, the elbows of the player's arms should remain in close proximity to each other as the player is shooting the ball. Further, the shooting arm should remain in a position adjacent the player's torso.

These techniques have been developed through time and are generally regarded as proper shooting form. Unfortunately, not all players have access to a coach that can monitor whether the player is using and developing proper techniques while shooting a basketball. As a result, many players develop improper shooting techniques that become difficult to break, as the improper techniques eventually become the player's standard shooting form.

Certain devices have been developed that assist players in developing proper shooting techniques. U.S. Pat. No. 5,135,217 discloses a training device that trains a player in the use of proper wrist motion when shooting a basketball. The device is comprised of an upper arm band that wraps around the shooting forearm and secures a tension member to a finger harness that fits around the forefinger and middle finger of the player's shooting hand. The tension member keeps the wrist in a cocked position prior to shooting a basket and returns the wrist to that position after the ball has been shot. While this device may assist a player in developing proper wrist motion, it does not develop proper arm positioning. Thus, a player that uses this device may develop proper wrist motion but also develop improper techniques with respect to arm positioning. Moreover, because the hand harness attaches to only the middle finger and forefinger of the shooting hand, constant use of the device may irritate the fingers and cause them to become sore. Further, the device does not simulate the feeling of a basketball on the fingers, i.e., having a basketball exert pressure on all of the fingertips on the shooting hand. Hence, the device can be impractical as the player must generally use the device with a basketball if he or she desires a realistic training experience.

U.S. Pat. No. 4,377,284 discloses another basketball training device that is designed to maintain the player's elbows in close proximity while shooting a basket. The device includes a pair of sleeves that fit over the forearms of the player. The sleeves are attached by a resilient member. This device is generally directed towards maintaining the player's elbows in close proximity and limiting the guide arm from being used to project the ball when shooting. Hence, while a player may use this device to develop proper techniques with regards to arm positioning, the player may simultaneously develop improper techniques with regards to wrist movement. Moreover, this device may be awkward in use, as it does not allow for separate movement of the forearms.

Hence, there is a need for a device that may be used to train a basketball player to simultaneously develop both proper wrist motion techniques and proper arm positioning techniques for shooting a basketball. It is desirable that the device should simulate the pressure that a basketball exerts against the shooter's fingers and not irritate any of the fingers.

SUMMARY OF THE INVENTION

The aforementioned needs are satisfied by the present invention which is an apparatus that may be used to train a basketball player to develop and use both proper wrist motion and proper arm positioning while shooting a basketball. A first sleeve is adapted to be placed around the bicep area of the player's guide arm. The first sleeve is attached by a connecting member to a second sleeve, which is adapted to be placed around the bicep of the player's shooting arm. A tension member interconnects the second sleeve to a forearm sleeve, which is adapted to be placed around the forearm of the player's shooting arm. The tension member also connects the forearm sleeve to a disk, which may be placed over the fingers of the shooting hand.

In one aspect of the invention, the apparatus encourages the player to keep his or her elbows in close proximity to each other and the shooting arm in a position adjacent the player's torso. As discussed, the first and second sleeve are wrapped around the biceps of the guide arm and shooting arm, respectively. The connecting member connects the first sleeve and second sleeve so that the player's elbows remain in close proximity during shooting and the shooting arm remains adjacent the player's torso. In the preferred embodiment, the connecting member is a material that will allow some movement between the elbows but will urge the elbows into close proximity.

In another aspect of the invention, the device trains the player to use proper wrist motion. When the player places the disk over his or her shooting hand, the tension member between the disk and the forearm sleeve pulls the wrist towards the forearm and into a cocked or bent backward position. Although the wrist may be pivoted forward during shooting, the tension member will preferably return the wrist to a cocked position after shooting. In the preferred embodiment, the forearm sleeve is placed around the wrist of the shooting arm.

In yet another aspect of the invention, the disk is placed over the fingers of the shooting hand such that the tension between the disk and the forearm sleeve causes the disk to exert pressure against all of the fingers of the shooting hand. This will simulate the feel of a basketball resting on the fingers of the shooting hand and provide for a more realistic trainer. Because the device applies pressure to all of the fingers, rather than only select fingers, the likelihood that certain fingers will be irritated is reduced. In the preferred embodiment, the disk is round and has a cut-out so that the disk will not butt against the forearm when the wrist is uncocked.

Hence, the present invention is an apparatus that may be used to train a basketball player in the proper techniques of shooting a basketball. In particular, the apparatus will train a player to use correct wrist motion during shooting and will also train the player to locate his or her arms in a proper position relative to each other and to the player's body.

DETAILED DESCRIPTION OF THE PREFERRED EMBODIMENT

Figure 2:
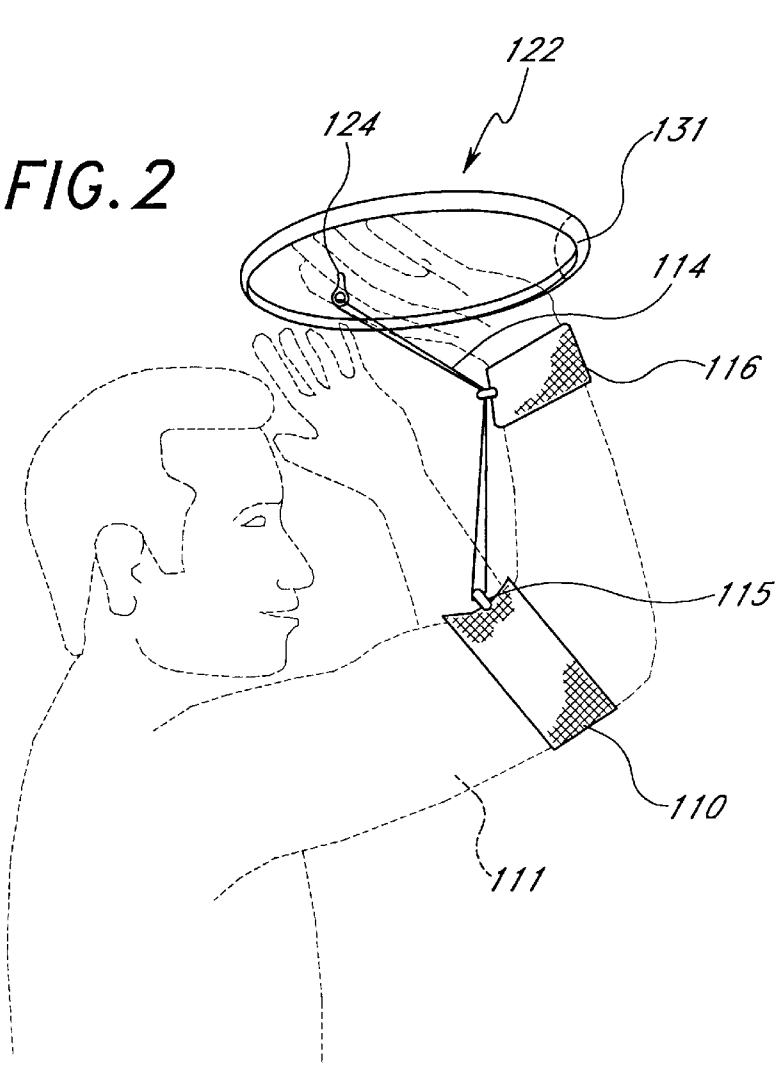
FIG. 2 is a perspective view of the basketball shooting trainer as it is worn by a user with the user's hand in a cocked position.
Figure 1:
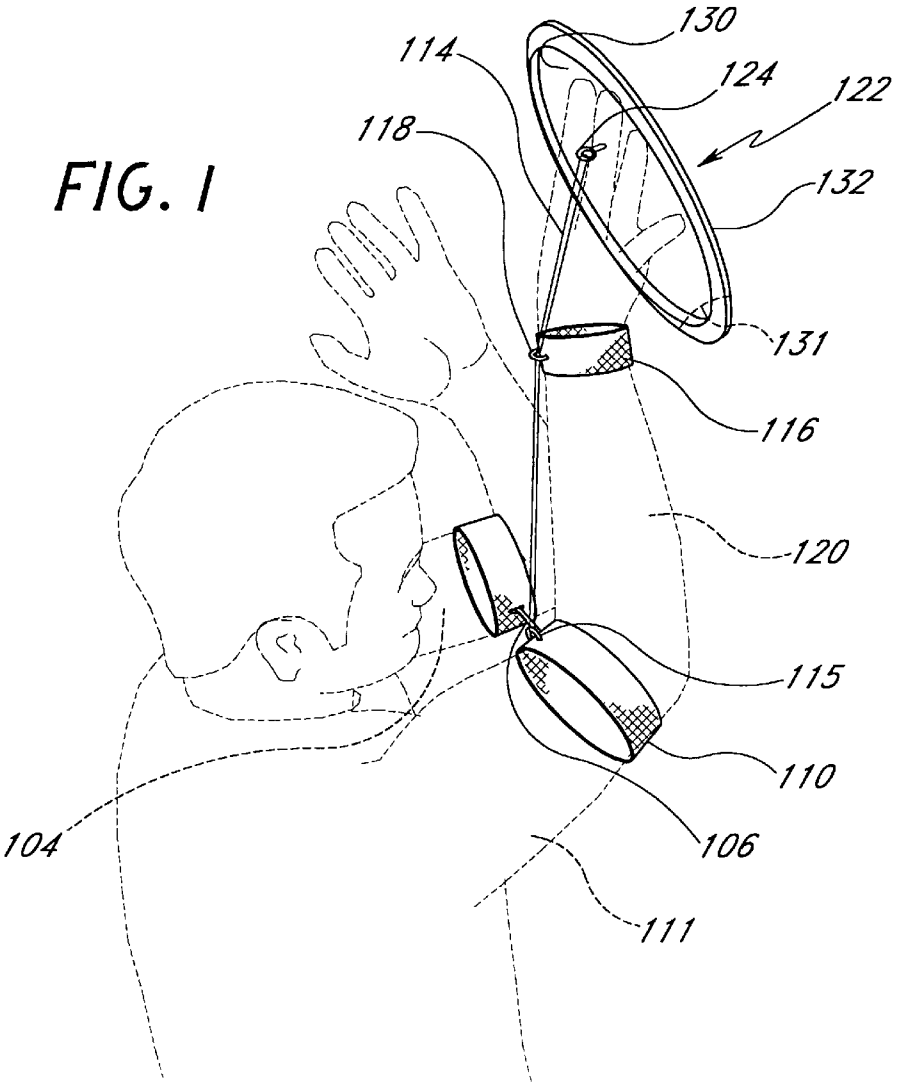
FIG. 1 is a perspective view of the basketball shooting trainer as it is worn by a user with the user's hand in an uncocked position.

Reference will now be made to the drawings wherein like numerals refer to like parts throughout. FIGS. 1 and 2 are perspective views of a basketball shooting trainer 100 that is being worn by a player.

A first arm sleeve 102 is adapted to be worn around the player's upper guide arm 104. The arm sleeve 102 is preferably comprised of a strip of material having VELCRO at each end. The arm sleeve 102 is wrapped around the player's upper guide arm 104 and secured by attaching the VELCRO ends together.

A second arm sleeve 110 is adapted to be worn around the upper portion 111 of the player's shooting arm 112. In a preferred embodiment, the second arm sleeve 110 is comprised of a strip of material having VELCRO at each end. The second arm sleeve 110 is wrapped around the player's shooting arm 104 and secured by attaching the VELCRO ends together. A hook 115 is attached to the outside surface of the second arm sleeve, as shown in FIGS. 1 and 2. The second arm sleeve 110 is preferably worn adjacent the elbow of the shooting arm 112.

A cord-like connecting member 106 connects the first arm sleeve 102 to the second arm sleeve 110 such that the elbows will remain in close proximity when the first arm sleeve 102 and the second arm sleeve 110 are worn. Preferably, when the player's elbows are in "close proximity", the elbows are separated by a distance no greater than the width of the player's chest or torso. Additionally, the shooting arm 112 is urged by the connecting member 106 to remain in a position adjacent the torso of the player. In the preferred embodiment, the connecting member 106 is made of a material that will not totally constrain the elbows from moving apart from each other but will encourage the elbows to remain in close proximity to each other. Preferably, the connecting member 106 can be adjusted so that the distance between the first arm sleeve 102 and the second arm sleeve 110 can be varied to suit a particular player.

A forearm sleeve 116 is adapted to be worn around the forearm 120 of the user's shooting arm. The forearm sleeve 116 is preferably comprised of a strip of material having VELCRO at each end. The forearm sleeve 116 is wrapped around the player's shooting forearm 120 and secured by attaching the VELCRO ends together. A hook 118 is attached to one side of the forearm sleeve 116. The sleeve 116 is worn around the user's forearm 120 in a position substantially adjacent the wrist of the shooting arm 112 such that the hook 118 is facing outward.

A disk 122 is flat and preferably round, having a bottom side 130 and a top side 132. A hook 124 is attached to the perimeter area of the bottom side 130 of the disk 122. In a preferred embodiment, a notch 131 is formed on the perimeter of the disk to prevent the disk from colliding with the player's wrist during use of the trainer 100. A flexible tension member 114 connects the hook 124 on the disk 122 to the hook 115 on the second sleeve 110, as shown in FIG. 2. Further, the tension member 114 runs through the hook 118 on the forearm sleeve 116. Hence, the tension member 114 connects the second sleeve 110 to the disk 122 through the hook 106 on the forearm sleeve 116. The tension member 114 is sized so that it will be in a state of tension when the disk 122 is placed over the player's shooting hand 126. Preferably, the length of the tension member 114 is adjustable so that the device 100 may be used by players with different arm lengths.

A player uses the device 100 by first wrapping the first arm sleeve 102 around his or her upper guide arm 104. The second arm sleeve 110 is then secured around the upper portion 111 of the player's shooting arm and the forearm sleeve 116 is placed around the player's shooting forearm 120. The bottom side 130 of the disk 122 is then placed over the fingers of the user's shooting hand 126, such that the bottom side 130 of the disk 122 rests over the shooting hand's fingertips.

The tension member will cause the bottom side 130 of the disk 122 to exert pressure against the fingertips of the shooting hand. The disk 122 preferably simulates the feel of a basketball against the fingertips of the shooting hand. Hence, it is not necessary that a basketball be used to train with the device. Because the pressure is spread to all of the fingers rather than to only one or two fingers, the likelihood that certain fingers will become sore due is reduced.

As the tension member 114 runs through the hook 118 on the forearm sleeve 116, it will exert tension between the forearm sleeve 116 and the disk 122. Preferably, the tension urges the wrist to cock, or bend backward, towards the forearm, as shown in FIG. 2. The user may then perform a shooting motion by uncocking the wrist, as shown in FIG. 1. Upon completion of the shooting motion, the tension member preferably causes the wrist to return to a cocked position by providing tension between the disk 122 and the forearm sleeve 116.

Preferably, the connecting member 106 will force the player to keep his or her elbows in proper proximity to each other while the player is practicing the wrist motion and also encourage the player to keep the shooting arm in a position adjacent the torso. As discussed, the player's elbows are preferably separated by a distance no greater than the width of the player's chest. Furthermore, the shooting arm is preferably maintained in a substantially vertical orientation with the elbow bent, as shown in FIGS. 1 and 2. That is, the forearm and upper arm define a plane that is preferably oriented substantially vertical. The shooting arm desirably remains aligned within this plane during the entire shooting motion. The connecting member 106 assists the player in maintaining the shooting arm in a substantially fixed vertical plane by urging the elbows together and thereby reducing the likelihood of the player moving the shooting elbow out of the plane when shooting. In this manner, the player preferably develops proper wrist techniques and proper arm positioning techniques at the same time.

Hence, the device 100 may be used to train a player in proper wrist motion for shooting a basketball while simultaneously training a player in proper arm positioning. A player may repeatedly perform the shooting motion while wearing the device so that the player's muscles memorize and grow accustomed to the proper shooting technique. Further, the device does not have to be used with a basketball, as the pressure that the disk 122 provides to the shooting fingers preferably simulates the pressure that a basketball exerts against the fingers when shooting. Because the disk 122 provides pressure to all of the shooting fingers, rather than to only select fingers, the likelihood that the fingers will be irritated is reduced.

Although the preferred embodiment of the present invention has shown, described, and pointed out the fundamental novel features of the invention as applied to these embodiments, it will be understood that various omissions, substitutions, and changes in the form of the detail of the device illustrated, may be made by those skilled in the art without departing from the spirit of the present invention. For example, although the illustrated embodiment demonstrates the right arm as the shooting arm and the left arm as the guide arm, it will be understood that the device may also be adapted to be used with a player who uses his or her left arm as the shooting arm and right arm as the guide arm. Further, although in the described embodiment velcro was used to attach the ends of the sleeves together, a person skilled in the art will appreciate that other means could be used, such as hooks.

What is claimed is:

1. An apparatus for training a player to shoot a basketball, comprising:

a first arm attachment member sized to be worn around the player's upper guide arm;

a second arm attachment member sized to be worn around the player's upper shooting arm;

a connecting member interconnecting said first arm attachment member and said second arm attachment member, said connecting member sized to resiliently retain the player's guide arm and shooting arm in close proximity;

a third arm attachment member adapted to be worn around the player's shooting forearm;

a disk having a surface configured to be placed over the hand of the shooting arm;

a tension member interconnecting said disk to said second arm attachment member, said tension member sized to be in tension when the disk is placed over the hand of the shooting arm so that the disk exerts pressure against said hand to resiliently retain the shooting arm in a starting position wherein the elbow of the player's shooting arm is in a bent position and the wrist of the player's shooting arm is in a cocked position, wherein the tension member is attached to the disk so that the player can simulate a basketball shooting motion by simultaneously unbending the elbow and uncocking the wrist from the starting position while the connecting member retains the elbow in close proximity to the guide arm during the shooting motion and wherein the disk and tension member resiliently oppose the shooting motion and urge the shooting arm into the starting position so that the player can repetitively perform the shooting motion.

2. The apparatus of claim 1, wherein the connecting member comprises a resilient cord.

3. The apparatus of claim 1, wherein said first, second and third arm attachment members each comprise a sleeve.

4. The apparatus of claim 1, wherein the tension member comprises a resilient cord.

5. The apparatus of claim 1, wherein the third arm attachment member is worn around the wrist of the player's shooting forearm.

6. The apparatus of claim 1, wherein said tension member additionally connects said disk to said third arm attachment member.

7. The device of claim 1, wherein the first and second arm attachment members are worn near the elbows of the player's upper guide arm and shooting arm, respectively.

8. A device for training a player in shooting a basketball, comprising:

a first upper arm attachment member and a second upper arm attachment member configured to be worn around the first and second upper arms of the player;

a connecting member connecting said first and second upper arm attachment members, said connecting member configured to maintain the player's upper arms separated by a distance less than or equal to the width of the player's chest wherein the connecting member urges the player's first arm to remain in a substantially vertical plane during a shooting motion;

a wrist attachment member configured to be worn around the wrist of the player's first arm;

a basketball simulation device configured to be placed over the hand of the player's first arm;

a tension member connecting said basketball simulation device to the first upper arm attachment member, said tension member configured to resiliently pull said basketball simulation device toward said first upper arm so that said first arm is urged to bend into a starting position wherein the elbow is bent and the wrist is cocked, wherein the tension member is attached to the basketball simulation device so that the player can simulate a basketball shooting motion by simultaneously unbending the elbow and uncocking the wrist from the starting position while the connecting member retains the elbow in the vertical plane during the shooting motion and wherein the basketball simulation device and the tension member resiliently oppose the shooting motion and urge the first arm into the starting position so that the player can repetitively perform the shooting motion.

9. The device of claim 8, wherein the basketball simulation device is a disk.

10. The device of claim 8, wherein the first and second upper arm attachment members and the wrist attachment members comprise sleeves.

11. The device of claim 8, wherein said first and second upper arm attachment members are worn near the elbows of the player's first and second arms.

12. The device of claim 8, wherein said basketball simulation device comprises a disk.

13. The device of claim 8, wherein said connecting member exerts pressure between said first and second upper arm sleeves to maintain the player's shooting arm aligned in a substantially vertical plane during the shooting motion.

14. An apparatus for training a player to shoot a basketball, comprising:

an arm positioning apparatus configured to urge the arms of the players toward each other, the arm positioning apparatus comprising sleeves configured to be positioned on separate arms of the player, and a connecting member interconnecting the sleeves;

an arm shooting apparatus configured to urge one of the player's arms into a position with the elbow bent and the wrist cocked, said arm shooting apparatus comprising a device configured to be placed over the player's shooting hand, a wrist band configured to be attached to the wrist of said one of the player's arm, and a tension member attaching said device to said wrist band and said wrist band to one of said sleeves.

15. The apparatus of claim 13, wherein said sleeves of said arm positioning apparatus are configured to be worn on the player's upper arms.

16. The apparatus of claim 15, wherein said sleeves are worn near the player's elbows.

17. The apparatus of claim 16, wherein the arm positioning apparatus urges the player's elbows to be separated by a distance not larger than the width of the player's chest.

18. The apparatus of claim 16, wherein the arm positioning apparatus urges the player's shooting arm to remain aligned in substantially vertical plane.

19. The apparatus of claim 14, wherein said tension member attaching said device to said wrist band is a resilient cord.

* * * * *